United States Patent [19]

McDaniel

[11] 4,156,398

[45] May 29, 1979

[54] APPARATUS FOR APPLYING A HOT MELT ADHESIVE PATTERN TO A MOVING SUBSTRATE

[75] Inventor: David C. McDaniel, Lorain, Ohio

[73] Assignee: Nordson Corporation, Amherst, Ohio

[21] Appl. No.: 823,268

[22] Filed: Aug. 10, 1977

[51] Int. Cl.[2] ..... B05C 11/00

[52] U.S. Cl. ..... 118/2; 118/8; 118/313; 118/DIG. 3; 53/383; 93/36 MM; 427/285; 427/286

[58] Field of Search ..... 118/2, 8, 313, DIG. 3; 156/356, 357, 578; 53/383; 93/36 MM; 427/285, 286

[56] References Cited

U.S. PATENT DOCUMENTS

| | | | |
|---|---|---|---|
| 2,864,549 | 12/1958 | Hayward et al. | 229/57 |
| 3,152,923 | 10/1964 | Marshall et al. | 118/2 |
| 3,327,680 | 6/1967 | Talbot | 118/2 |
| 3,340,847 | 9/1967 | Miller et al. | 118/2 |
| 3,425,393 | 2/1969 | Shuh et al. | 118/2 |
| 3,595,204 | 7/1971 | McIntyre et al. | 118/8 |
| 3,645,815 | 2/1972 | Bedore | 156/69 |
| 3,682,131 | 8/1972 | Algeri et al. | 118/2 |
| 3,831,342 | 8/1974 | Rejsa | 53/491 |
| 4,059,466 | 11/1977 | Scholl et al. | 156/578 X |

*Primary Examiner*—Robert Mackey

*Attorney, Agent, or Firm*—Wood, Herron & Evans

[57] ABSTRACT

Hot melt adhesive is applied to a moving substrate in a pattern including at least two lines which extend transversely to one another, by conveying the substrate past a nozzle orifice through which a first line of molten adhesive is applied, as by extrusion, to the substrate parallel to the direction of substrate movement and, while continuing to move the substrate in the same direction, projecting another portion of the molten hot melt adhesive onto the substrate as a burst in the form of a flat sheet issuing from a fan spray orifice, this orifice being oriented so that the sheet is projected transversely to the direction of substrate movement, and terminating the burst so rapidly that the adhesive so projected is deposited on the moving substrate in the form of a line having a length in the crosswise direction that is several times its width.

11 Claims, 11 Drawing Figures

APPARATUS FOR APPLYING A HOT MELT ADHESIVE PATTERN TO A MOVING SUBSTRATE

FIELD OF THE INVENTION

This invention relates to a method and apparatus for applying hot melt adhesive to a substrate such as a corrugated container flap, a paper sack bottom closure, or a disposable diaper lamina, while the substrate is rapidly moving relative to an applicator station. More particularly, it relates to application of hot melt adhesive in a pattern which includes at least one line or bead of the adhesive that runs parallel to the direction of substrate movement and at least one other line of adhesive that extends in a direction across or perpendicular to the direction of substrate movement.

BACKGROUND

Hot melt adhesives are becoming increasingly widely used to secure substrates together in a great variety of applications. These materials are essentially solvent-free adhesives which are applied in a molten state and form a bond upon cooling to a solid state. By reason of their quick-setting characteristics, their adhesive "tack", and their gap-filling properties, they are highly useful for a myriad of industrial adhesive applications.

Because of their rather short "open time" after application, while they are sufficiently fluid to be receptive for adhering a substrate, hot melt adhesives must be applied rapidly and the closure effected quickly. They are very viscous, even as melted, and it has therefore been the usual practice to apply them by extrusion as a line or bead, directly onto the substrate to be bonded.

In many sealing, laminating, or "gap-filling" operations it is desirable to apply adhesive to the substrate at a high rate of speed, in an adhesive pattern in which the adhesive lines on the substrate extend transversely or at right angles to one another. As an example, one such situation arises in the manufacture of paper bags, in the closure of the bag bottom flap structure. As shown in Hayward et al U.S. Pat. No. 2,864,549, and in Bedore U.S. Pat. No. 3,645,815, an adhesive is applied in a "U-shaped" pattern to the bag end flap structure forming a block-U or block-C shape, following which the flaps are folded over and sealed together. After such folding and sealing, this adhesive pattern provides a continuous line or bead of glue along the edges of the flap and thereby forms a "sift-proof seal". Such complete sealing is desirable to eliminate any minute channels or openings through which granular material stored in the bag could filter out.

At the present time, in making such seals, an ordinary cold-setting adhesive is applied in the desired U-shaped pattern while the bag is traveling on a conveyor at a rate of 150–300 feet per minute, using a so-called "paster wheel" to apply the cold glue. A raised area on the wheel surface picks up the glue from a reservoir and carries it to the moving bag where the rolling movement of the wheel relative to the bag transfers the glue in the U-shaped pattern.

THE PROBLEM IN THE ART

While the paster wheel adhesive application technique is suitable for use in applying U-shaped patterns of cold setting adhesives, it is not suitable for such use with adhesives of the hot melt type. It has been impracticable to apply hot melt adhesives by the paster wheel technique because of their "stringiness", which causes clogging of the machinery, and because of their short open pot life. As mentioned, these adhesives can be applied by extruding a bead from a nozzle directly onto the substrate surface. It can be seen that, as the substrate is moved past a hot melt extruding nozzle, the stream of extruded material will deposit as a line parallel to the direction of substrate movement. However, it will be apparent that extrusion cannot readily be used to form any adhesive pattern that is to include a line transverse (i.e., perpendicular or angulated) to the direction of substrate movement. This has hindered the use of hot melt glues for many sealing applications, since as described above such transversely lined adhesive patterns are frequently needed.

Thus, there has existed a need for a method and apparatus to apply hot melt adhesive to a rapidly moving substrate such as a container or lamina in a pattern which includes at least one line parallel to the direction of substrate movement and another line substantially perpendicular to the first.

One proposal for solving this problem in the application of hot melt glues is shown in Rejsa U.S. Pat. No. 3,831,342 which shows apparatus for producing adhesive lines running crosswise on a carton flap by moving an extrusion nozzle diagonally across the carton as the carton itself moves, so that the relative movement between the carton and the adhesive nozzle is at right angles to the main axis of the carton and thereby producing a bead that is perpendicular to the direction of carton travel. That technique requires complicated mechanism for moving the nozzle in the necessary timed diagonal relation to the carton movement.

As another approach to the problem, it has been proposed to extrude hot melt glue lines in a first direction of substrate travel, then to stop the substrate and commence moving it in a direction perpendicular to the first, and then extrude a glue line in that second direction so as to form the desired right angular pattern of glue lines. That technique requires relatively complex machinery to achieve accurately aligned right angular movements of the substrate. Moreover, the hot melt adhesive first applied is cooling while the second (or perpendicular) line is being applied, which reduces the available "open time" during which the adhesive is receptive to adherence to the surface to which it is to bond.

BRIEF DESCRIPTION OF THE INVENTION

This invention is predicated on the discovery that it is possible to apply hot melt adhesive in a pattern having lines both parallel to and perpendicular to the direction of substrate movement by a combination of operations, carried out while the substrate is moving in a single given direction, wherein the substrate is moved past an orifice from which hot melt adhesive is applied, preferably by extruding, to form a bead extending in that direction, while another quantity of the same adhesive is hydraulically projected as a timed short burst in the form of a flat sheet through a fan spray orifice oriented transversely to the first bead. Surprisingly, I have found that hot melt adhesive, even though molten, can for short periods be projected as a flat sheet which is quite thin and which, moreover, flows out very little when it impinges on the substrate, but rather remains as a well defined continuous sharp line. The burst is timed to have a duration so short, in relation to the rate of substrate movement, that the sheet deposits on the substrate as a discrete line or ribbon having a width which is only a fraction of its length.

Unlike other materials, when hot melt adhesive is projected as a flat sheet through a fan spray orifice, the moving sheet may tend to "collapse" or decay rapidly, to a much narrower configuration. That is, a fan which as first projected has a width of, say, 4 inches, will rapidly collapse to a thicker, narrower fan having a width of perhaps only 2 inches. This odd effect may be caused by the high viscosity and surface tension of molten hot melt adhesive. In any event, the collapse very quickly follows the commencement of spraying, by a lag much less than one second, as can be demonstrated by continuously projecting a stream onto a moving substrate: the line of deposited adhesive abruptly narrows soon after the start. This instability can be controlled by increased pressure, but at the pressure ordinarily used, the observed instability would suggest that well defined patterns could not be formed by depositing hot melt as a fan pattern from a spray nozzle. However, in accordance with this invention the effect of the instability is avoided by terminating the projected stream quickly, i.e., before the stream collapses. The time span before collapse varies with pressures, adhesive, temperature, and so on; I prefer to terminate the burst after no more than about 33 milliseconds, as this gives good results in many cases.

Apart from the problem of fan collapse first described, it might be further expected, by reason of the high viscosity of hot melt adhesives, that such materials could not effectively be sprayed through a spray nozzle as a thin sheet. To the contrary, however, I have found that in fact they will form a sheet which is very thin, for example, only about 0.1 inches through the sheet moving from the orifice, at a point adjacent where the sheet impinges on the substrate. Moreover, as this sheet impinges on the substrate it does not splatter or flow out laterally but, if terminated very rapidly, will form a sharply defined line, unlike sprayed materials of low viscosity. In practice it has been found possible to apply sharply defined lines having a width as small as ¼ inch by this technique, even to substrates running at rates of more than 1 foot per second in the direction across the line.

Thus, to accomplish the formation of a narrow line which extends transverse to the direction of substrate movement, it is necessary that the duration of the spray burst be very brief, especially as the rate of substrate movement increases. By way of example, in order to form a line which, as deposited and prior to any flow caused by compression in sealing, is ½ inch in width on substrate traveling at a rate of 250 feet per minute, the duration of spray burst must be no more than 10 milliseconds (0.010 sec.). In contrast, the extrusion times for the other lines are usually at least four times longer.

As mentioned, to achieve such narrow spray patterns, it is necessary to use nozzles or tips of the so-called "flat pattern" or fan spray type. The fan may have an angular width of as much as 40°; this factor and the spacing between workpiece and nozzle will determine length of the transverse line. To form longer lines multiple guns may be used.

This invention can usefully be carried out with conventional hot melt adhesives, wherein the adhesive is applied as a continuous liquid phase to the substrate. However, I have found it is surprisingly advantageous to carry out the invention by utilizing, as the adhesive for both the extruded bead and the transverse line, a foamed hot-melt adhesive. Adhesives of this type, recently invented, are disclosed in the co-pending application of Scholl, Janner, and Stumphauzer, titled "Hot Melt Thermoplastic Adhesive Foam System", Ser. No. 710,377 filed Aug. 2, 1976, now U.S. Pat. No. 4,059,714, issued Nov. 22, 1977; in the co-pending application of Scholl, Janner, Stumphauzer and Shuster, Ser. No. 710,378, titled "Hot Melt Thermoplastic Adhesive Foam System", filed Aug. 2, 1976, now U.S. Pat. No. 4,059,466, issued Nov. 22, 1977 and in the co-pending application of Cobbs and Shong, titled "Method of Making Foamed Thermoplastic Materials", Ser. No. 791,338, filed Apr. 27, 1977 all of which are assigned to the assignee of this invention and; the disclosures of all of which and hereby incorporated by reference in this application.

Briefly, as there described in detail, a foamed hot melt adhesive is created by intimately mixing air or another relatively inert gas with the thermoplastic adhesive while the adhesive is in the liquid state, and then pressurizing the liquid/gas mixture to force the gas into solution with the liquid adhesive. The liquid adhesive is subsequently dispensed at atmospheric pressure with the result that the gas is released from solution and becomes entrapped in the adhesive to form a homogeneous closed cellular adhesive foam. When the hot adhesive foam is compressed or squeezed between two substrates to adhere them, gas is forced from the foam and a bond is formed between the substrates. As shown in the Scholl et al application Ser. No. 710,337, the foam hot melt adhesive system is a great improvement over non-foam hot melt systems, in respect to open time. Non-foam hot melts have a shorter open time resulting from relatively high viscosity, high surface tension and quick setting time, which combine to prevent the adhesive from spreading over a large surface area when the adhesive is applied as a liquid to the substrate. Moreover, the adhesive strength of a bond achieved with a given quantity of a given hot melt adhesive is appreciably improved and in most instances will be doubled if the adhesive is applied as a cellular foam rather than as a conventional non-foam adhesive.

In a preferred embodiment for forming the previously mentioned U-shaped adhesive pattern on a container made from a blank having foldable closure-forming flaps, which are to be overlapped and sealed by adhesive, the adhesive is applied according to the method of this invention by conveying the container past two spaced apart hot melt extrustion nozzles and extruding two lines of adhesive from the nozzles onto a flap, the two lines extending parallel to the direction of movement of the container. While conveying the container in that direction, and preferably simultaneously with the start of the extrusion, a burst of hot melt adhesive is projected as a flat, thin sheet through a fan spray nozzle which is oriented transversely to the direction of container movement. The duration of the burst is timed in accordance with the rate of substrate movement to provide a line width (dimension in the direction of movement) which is substantially less than line length, less than ¼ the length in most cases. This line will desirably intersect the extruded lines to form a closed "U" for forming a sift-proof closure, although in other instances where that feature is not desired the lines may be spaced apart, or the lines may be interrupted or discontinuous.

The apparatus for carrying out the invention includes a conveyor for moving the substrate through an adhesive-applying station, adhesive applying means including at least one gun having a nozzle or orifice in the station adjacent the path of movement of the substrate for depositing hot melt adhesive as a line parallel to the direction of substrate movement, thereby to form a line. Timing means is provided for actuating this gun to operate for a period selected to provide a desired line length. The timer may be pulsed or cycled so as to provide a bead-gap-bead pattern, i.e., a stitched or interrupted line. The adhesive applying means also includes a gun having a flat spray nozzle in the station for projecting hot melt adhesive as a transverse liquid sheet, directed in a plane angulated across the direction of substrate movement. Timing means is provided for actuating the sheet projecting gun to operate for a period selected such that the adhesive from it will deposit as a line on the substrate having a width substantially less than its length.

In tests it has been found that the apparatus described can apply hot melt adhesive at rates which at least match rates attainable with conventional cold adhesive but which have heretofore not been available with hot melts for such patterns. It will be seen that the apparatus does not necessarily require movement of any of the nozzles, in contrast to U.S. Pat. No. 3,831,342, previously referred to, nor does it require change in the direction of substrate movement, in contrast to the right angular system of container movements previously referred to.

The invention can best be further described by reference to the accompanying drawings, in which FIG. 1 is a plan view, somewhat diagrammatic in nature, showing apparatus for applying adhesive in a U-shaped pattern to the bottom closure flaps of a self-opening square paper sack in accordance with one embodiment of the invention;

Figure 10:
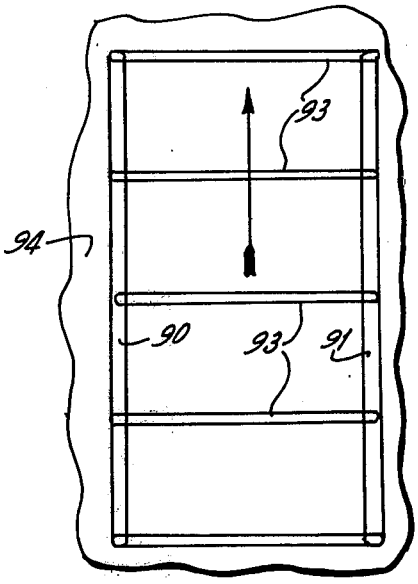
Figure 9A:
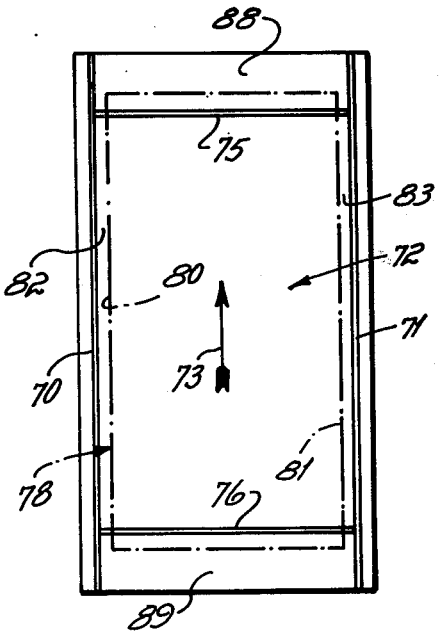
Figure 9B:
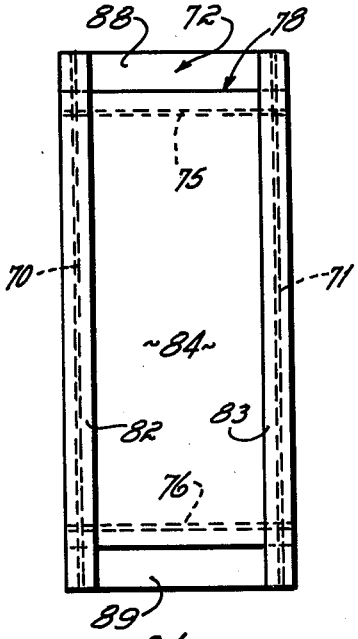

FIG. 9*a* is a plan view of a plastic cover sheet of the type used in the manufacture of a disposable diaper, having a rectangular pattern of hot melt adhesive lines applied to it preparatory to securing to an absorbent pad;

FIG. 9*b* is a view similar to FIG. 9*a* but showing an absorbent pad secured to the cover sheet; and FIG. 10 is a plan view of still another adhesive pattern on a substrate, applied by use of the invention.

DETAILED DESCRIPTION

Figure 1:
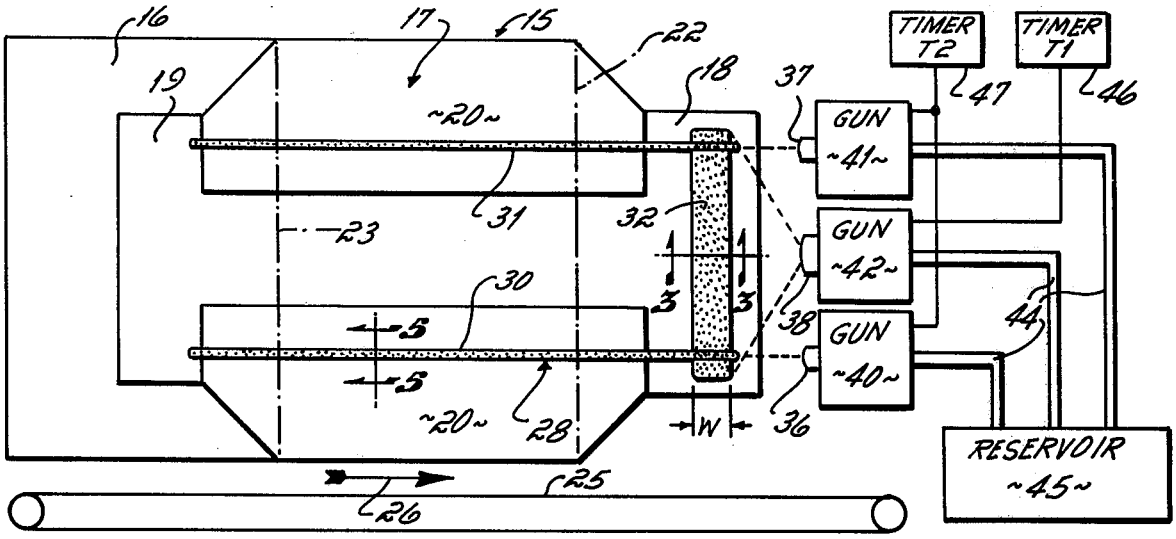

As previously indicated, the invention finds utility, among other purposes, in applying adhesive in a U-shaped pattern to the bag bottom closure flaps of a self-opening sack ("SOS"). Apparatus in accordance with this invention for applying such a pattern is illustrated in FIG. 1. A partially folded self-opening square bag blank is indicated generally by 15, which may be of the type shown in Hayward et al U.S. Pat. No. 2,864,549 previously mentioned. The bag may be of multiple plies; and while in this instance the closure shown for purposes of illustration is a bottom closure, it should be noted that the invention is also useful in making top or side wall closures. Bag 15, which in this case is the "substrate" to which the adhesive is to be applied, has a tubular body 16 with longitudinally extending side gussets, not shown, so that the bag can be collapsed flat to be expanded readily for use. On one end the bag body is formed and folded to provide a bottom structure 17 presenting bottom closure flaps 18 and 19 on either side of bottom center flaps 20, 20. The flaps 18 and 19 are foldable about fold lines at 22 and 23, respectively, to seal the bottom of the bag.

In a bag-making production flow stream, the bag 15 is moved as by a conveyor shown diagrammatically at 25 in the direction indicated by the arrow 26, so that flap 18 constitutes the leading flap. As shown in FIG. 1, adhesive is to be applied in a U-shaped pattern, indicated generally at 28, to the flaps 18, 19 and 20. More specifically, the pattern shown includes two beads of adhesive 30 and 31 which are parallel to the direction of bag travel, i.e., parallel to the arrow 26, and which run from the flap 18 across the bottom center flaps 20, 20 onto trailing flap 19. These are cross-connected by a ribbon or strip of adhesive 32 on flap 18 which intersects the lines 30 and 31 adjacent their leading ends.

In accordance with this invention, adhesive is applied in the described U-shaped pattern by a combination of steps involving application from separate stationary nozzles. More particularly, the elongated beads of adhesive 30 and 31 are applied as by extrusion from two spaced apart extrusion orifices presented in nozzles designated at 36 and 37 respectively, while the transverse ribbon of adhesive 32 is applied by projecting a burst of the same material as a flat fan through an orifice present by a spray nozzle 38. The nozzle 38 is positioned between the two extrusion nozzles.

The extrusion nozzles 36 and 37 are mounted to hot melt guns 40 and 41 which, for purposes of description, may be considered to be similar to each other. Spray nozzle 38 is mounted to a gun 42. The guns 40, 41 and 42 may all be similar; but they provide different outputs as will be seen.

In practice it is contemplated that the three guns 40, 41 and 42 may be mounted in line, spaced slightly above the path of movement of the bag 15. The extrusion nozzles may be spaced about ½ to as much as 4 inches from the substrate; a spacing of about ½" is most generally useful. The spray nozzle, because of the distance it must project to achieve the desired line length, may be mounted for example 2–3" from the substrate. The guns do not themselves comprise the invention; one suitable form for such guns is shown in Baker et al Reissue U.S. Pat. No. 27,865, reissued Jan. 1, 1974, to which reference may be had. It is important that all the guns be of the so-called "airless" type, rather than of the "air spray" type. This has been found necessary to achieve sharp line definition, apparently because it minimizes stringing and diffusion of the streams issuing from the guns.

Each gun 40, 41 and 42 is supplied with hot melt adhesive in molten form through separate heated hoses each designated by 44. The hoses are supplied under pressure with adhesive, preferably from a common supply, indicated diagrammatically in FIG. 1 at 45. The supply itself may be of known type for supplying conventional non-foamed hot melt, for example as shown in Scholl U.S. Pat. No. 3,964,645, assigned to the assignee of this application, to which reference may be had for further description and detail. Briefly, such supply apparatus includes a hopper for receiving hot melt glue, a grid melter, a reservoir and a pump for forcibly moving the molten material through the hoses to the guns. Alternatively, and preferably, the supply is one which is adapted to supply foamed hot melt, as indicated previously. Such a supply is shown in Scholl et al application Ser. No. 710,377, previously mentioned. Commercially available hot melt adhesives are suitable for use in such supplies and guns in the practice of this invention, especially those adapted for adhesion to paper, corrugated board and sheet plastic webs.

Referring again to FIG. 1, the bag 15 is moved by the conveyor apparatus 25 at a line speed which may be as high as 150–300 feet per minute. The adhesive beads 30 and 31 are extruded while the bag is in constant lineal movement. At such high rates of bag movement, automatic timing means are required for gun operation. A timer 47 is used to operate guns 40 and 41 simultaneously. Since lines 30 and 31 have a length many times the width W of the transverse line 32, the extrusion guns 40 and 41 must be actuated for a period of time proportionately greater than the flat sheet projecting gun 42, and for that reason a separate timer 46 is used to operate or cycle the flat sheet projecting gun 42. A suitable structure for timers 46 and 47 is shown in Algeri et al U.S. Pat. No. 3,682,131, to which reference may be had.

Figure 4:
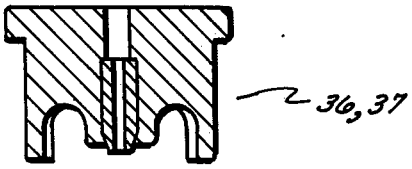
FIG. 4 illustrates one type of nozzle suitable for extruding a bead of hot melt adhesive.
Figure 5:
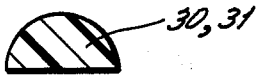
FIG. 5 is an enlarged vertical section taken on line 5—5 of FIG. 1, through the extruded bead viewed in the direction of substrate movement.

To extrude beads 30 and 31, the guns 40 and 41 are provided with the extrusion nozzles 36 and 37, which may be similar. One suitable configuration for these extrusion nozzles is shown in FIG. 4. The molten material is applied under hydraulic pressure to the guns, for example in the range of 100–1500 psi, and is projected as continuous, unatomized streams from the nozzles 36 and 37. Bead widths, as deposited and before compressing or sealing, of about 1/16–¼", are the most generally useful.

Figure 2:
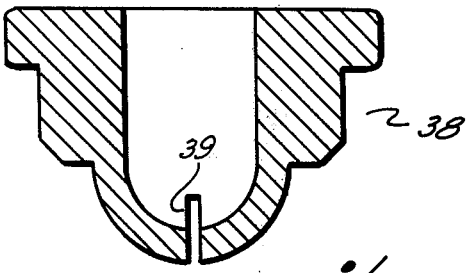
FIG. 2 illustrates one type of nozzle suitable for projecting hot melt adhesive as a thin, flat sheet.

The nozzle 38 used in forming the transverse ribbon 32 has a slot-like orifice and is of the type ordinarily used as a flat "spray" nozzle with other materials, but it is important to recognize that the flat sheet of hot melt adhesive projected through it differs from a true spray in that it is almost continuous and unatomized. The sheet diverges laterally as a fan, but the moving stream is very thin. FIG. 2 shows in enlarged detail one suitable configuration for the orifice 39 of nozzle 38 which is known as a "ribbon" nozzle. This particular orifice shape is not critical, and other orifice configurations can be used so long as they provide flat (i.e., sheet-like or fan) output stream patterns. Some hot melt compositions, when sprayed through certain nozzles, may display a tendency to "cobweb", i.e., to form hair-like strings of adhesive adjacent the nozzle. This is due to excessive atomization and can usually be avoided by changing the adhesive and/or using a different nozzle shape to produce a more ribbon-like output stream.

Figure 3:
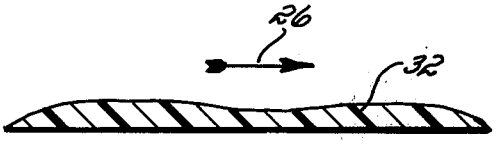
FIG. 3 is an enlarged vertical section taken on line 3—3 of FIG. 1, of the transverse ribbon of adhesive.

FIG. 3 illustrates in cross section an approximate profile of the ribbon 32 which is moving in the direction of arrow 26 relative to the nozzle 38.

By way of illustrating the operation of the flat sheet nozzle timer 46 in relation to the extruder timer 47, if, for example, the extruded beads 30 and 31 are each to have a length of 10 inches on a substrate traveling at a rate of 250 feet per minute, extruder timer 47 should be set to cause the extruder guns 40 and 41 to operate for a period of 0.2 seconds each. In comparison, the period of operation of flat sheet nozzle timer 46 necessary to produce a desired width W of ¼ inch is only about 10 milliseconds (0.010 second). The timer described in previously identified U.S. Pat. No. 3,682,131 can be set to provide such short time periods, with accuracies of about ±1 millisecond.

It is convenient although not necessary that all three guns be set in operation by the timers at the same instant; the extruder guns 40 and 41 will then operate beyond the time the gun 42 operates. If a period of time $T_1$ is required to produce the desired width W of ribbon 32 from gun 42, and a longer time of operation $T_2$ is required for the extruder guns 40 and 41 to produce the beads 30 and 31, then the extruder guns are in operation during the time period $T_2$–$T_1$ after gun 42 has been shut off. During this time hot melt adhesive will be drawn from supply 45 only by those guns; gun 42 will draw none. To produce a ribbon 32 having sufficient thickness for good adhesion (for example, about 2–3 mils), the gun 42 will usually be set at a flow rate that is substantially larger than that of guns 40 and 41 combined, because of the large adhesive coverage which it is to apply in time period $T_1$. Since that relatively heavy draw of adhesive from supply 45 is discontinued during the time of $T_2$–$T_1$, the output of extruder guns 40 and 41 will tend to increase abruptly when gun 42 is shut off, unless special precautions are taken, resulting in an increase in bead size. Such an uneven bead section condition could cause unsatisfactory bags due to excessive glue squeeze out and would of course raise adhesive cost per bag. To maintain constancy of cross-sectional areas of the beads 30 and 31 along their entire lengths (i.e., during the time $T_1$, as well as during $T_2$–$T_1$), the system may include a recirculation or flow control valve to insure constant outputs from the extruder guns whenever they are in operation, regardless of whether the other gun 42 is or is not operating at the same time. Such a recirculation valve is described in Scholl U.S. Pat. No. 3,964,645.

Although specific parameters will of course vary depending upon the adhesive, the nature of the substrate, ambient conditions, and other factors, by way of example and with reference to the U-shaped bag adhesive pattern described, the beads 30 and 31 may be 1/16 inches wide, 6 inches long, and spaced apart by 2¼ inches. The adhesive may be extruded through nozzles 40 and 41 at a temperature of 325° F. and projected through nozzle 42 at 375° F., the same adhesive (H. B. Fuller Co. synthetic resin hot melt adhesive, their design J-4100) being used to feed each gun.

Figure 6:
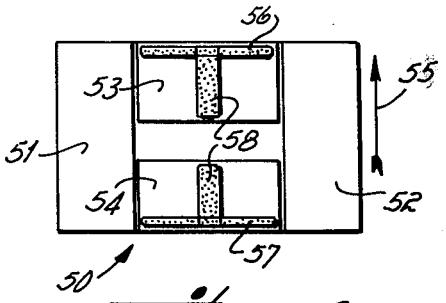
FIG. 6 is a top plan view of a partially closed corrugated box, illustrating another type of adhesive pattern applied thereto in accordance with this invention.

The U-shaped adhesive pattern shown in FIG. 1 is useful for many types of container sealing operations, but it should be understood that the invention is applicable in applying other adhesive patterns involving combinations of lines directed angularly to one another. By way of example, FIG. 6 shows corrugated box 50 having two side flaps 51 and 52, in open position, and top and bottom flaps 53 and 54, shown in closed position.

Each of the top and bottom flaps 53 and 54 is provided with a "T-shaped" adhesive pattern on its upper surface, to which the side flaps 51 and 52 are adhered when they are folded in. The adhesive pattern on flaps 53 and 54 includes lines 56 and 57, respectively, which run perpendicular to the direction of container movement (and perpendicular to the major axis of the side flaps) and lines 58, 58 forming the stems of the Ts, and which run parallel to the direction of motion. The carton is conveyed through an adhesive applying station in the direction of arrow 55, parallel to the axis of long flaps 51 and 52, although it could be run in the perpendicular direction. In this case the lines 56 and 57 are formed by bursts of hot melt projected as flat sheets through spray nozzles. Because of the long length of these lines it is contemplated that two guns spaced apart laterally are desirable to provide the desired length. The center lines 58, 58 can be extruded; alternatively, they can be applied in the same manner as the lines 56 and 57, using projections through a sheet nozzle, but with longer gun actuation to provide the desired length. This pattern provides a strong seal right at the flap edges.

Figure 7:
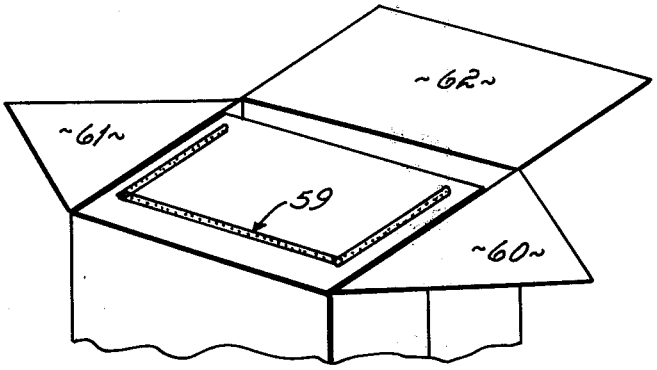
FIG. 7 is a fragmentary perspective view of a sugar sack having delta seal flaps for forming the end closure, illustrating another adhesive pattern applied thereto in accordance with this invention.

FIG. 7 illustrates a so-called "delta seal" of the type that is widely used to seal sugar bags and similar containers. This seal includes a U-shaped pattern 59 which may be applied generally in the same manner as the pattern already described in connection with FIG. 1. However, in the closure of this seal, unlike the bag seal shown in FIG. 1, the triangular or delta-shaped side flaps 60 and 61 are separately adhered to the rectangular flap 62 after the latter has been folded onto adhesive pattern 59.

Figure 8:
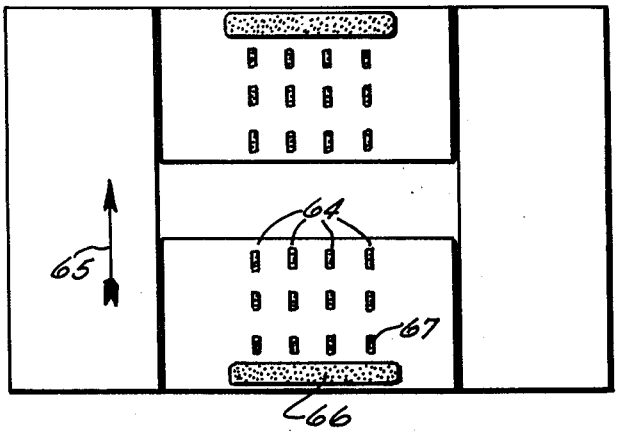
FIG. 8 is a top plan view of a partially closed corrugated box, showing a different pattern of adhesive applied in accordance with this invention.

FIG. 8 illustrates another useful adhesive pattern which can be advantageously applied by the apparatus and method of this invention. Here a series of parallel lines 64 in the direction of carton movement (arrow 65) is applied by pulsed extrusion from four guns. Each line 64 is interrupted along its length in a bead-gap-bead or "stitched" pattern. The transverse strip 66 of hot melt adhesive, formed by a fan pattern projected through a sheet spray nozzle, does not in this case actually intersect any of the individual beads 67. Use of a "dotted" adhesive pattern of this type may be desirable in order to comply with so-called "Rule 41" requirements relating to the amount and area of the surface to be coated by adhesive, as specified by National Motor Freight Classification Rules.

Another useful embodiment of the invention arises in connection with the lamination of sheet materials, for example in the production of disposable diapers, wherein a thin plastic film cover sheet is adhered to a fluffy absorbent material. In this application, as illustrated in FIGS. *9a* and *9b*, a pair of hot melt beads 70 and 71 are applied by extrusion to a thin plastic sheet 72, the sheet traveling in the direction of arrow 73. A second pair of hot melt lines 75 and 76 is applied by brief bursts of liquid hot melt projected through a sheet spray nozzle, oriented transversely to the direction of movement 73. An absorbent pad is then placed on the sheet 72, in the position indicated by the dashed lines 78 in FIG. *9a*. The pad 78 is engaged by the transverse hot melt adhesive lines 75 and 76 on its lower face. Its width is such that its longitudinal edges 80 and 81 are inward of the extruded beads 70 and 71. The marginal portions 82 and 83 of the cover sheet are folded over the pad edges 80 and 81, and are secured to the upper pad surface 84 (see FIG. *9b*). The leading and trailing transverse portions 88 and 89 of the cover sheet can be folded over and adhesively secured in known manner.

FIG. 10 illustrates a "ladder" adhesive pattern comprised of parallel extruded lines 90 and 91, cross-connected by a series of transverse lines 93. The transverse lines 93 can be applied as sequential bursts on the moving substrate 94, projected through a fan spray orifice by a series of pulses from a timer. This type of pattern is useful to provide adherence over a larger area, as between lamina of multi-ply bags.

While several different embodiments of the invention have been described, those persons skilled in the art will appreciate other changes and modifications that can be made without departing from the scope of the following claims:

I claim:

1. Apparatus for rapidly applying an adhesive pattern to a substrate while the substrate is moving, the pattern including at least one line of adhesive that extends in the direction of substrate movement and a second line of adhesive that extends in a direction transverse to said one line, said apparatus including, a conveyor for moving said substrate through an adhesive-applying station, a supply for providing molten hot melt adhesive under pressure, hot melt adhesive depositing means connected to said supply and including a first orifice in said station and adjacent the path of movement of said substrate for depositing said adhesive on said substrate as a line parallel to the direction of substrate movement, thereby to form said one line, hot melt adhesive applying means connected to said supply and including a flat spray second orifice for spraying hot melt adhesive toward said substrate in the form of a flat sheet having lateral edges which diverge angularly as a fan as said sheet moves from said orifice to said substrate, said flat spray orifice oriented to direct said flat sheet in a plane transverse with respect to the direction of substrate movement, and timing means for actuating said depositing means to operate for a period selected to deposit said one line in a desired length, and for actuating said applying means to project said flat sheet for a period so short such that the adhesive forms a second line on said substrate, said second line having a width substantially less than its length and extending transversely to said one line, said flat spray orifice being spaced from said substrate to establish a length of said second line which is substantially greater than the width of said flat spray orifice.

2. The apparatus of claim 1 wherein said first orifice is presented by an extrusion nozzle and said one line is deposited as an extruded bead.

3. The apparatus of claim 2 including a second extrusion nozzle for extruding another line of adhesive on said substrate, parallel to said one line, the parallel lines being spaced in the direction perpendicular to the direction of substrate movement.

4. The apparatus of claim 3 wherein said spray orifice is provided by a third nozzle, positioned between the two extrusion nozzles.

5. The apparatus of claim 4 wherein said spray orifice directs said flat sheet to form a line that intersects the parallel lines.

6. The apparatus of claim 1 wherein said flat spray orifice is oriented to direct said flat sheet to the side of said one line.

7. The apparatus of claim 1 wherein said spray orifice is oriented to direct said flat sheet to form said second line so that it intersects said one line at a right angle.

8. The apparatus of claim 1 wherein said timing means commences said depositing and projecting at substantially the same time.

9. The apparatus of claim 1 wherein said supply is of the type which is effective to supply a foam hot melt adhesive.

10. The apparatus of claim 1 wherein said timing means actuates said depositing means for a period at least four times the length of the period that said applying means is actuated.

11. The apparatus of claim 1 wherein said timing means actuates said applying means to project said sheet for not more than about 33 milliseconds.

* * * * *